US010513026B1

(12) United States Patent
Griffith

(10) Patent No.: US 10,513,026 B1
(45) Date of Patent: Dec. 24, 2019

(54) SURFACE GRINDING TOOL

(71) Applicant: United States of America as Represented by the Administrator of NASA, Washington, DC (US)

(72) Inventor: Charles W. Griffith, Huntsville, AL (US)

(73) Assignee: United States of America as represented by the Administrator of NASA, Washington, DC (US)

( * ) Notice: Subject to any disclaimer, the term of this patent is extended or adjusted under 35 U.S.C. 154(b) by 336 days.

(21) Appl. No.: 15/650,423

(22) Filed: Jul. 14, 2017

(51) Int. Cl.
*B24B 7/00* (2006.01)
*B25F 5/02* (2006.01)
*B24B 23/00* (2006.01)
*C22C 26/00* (2006.01)

(52) U.S. Cl.
CPC ..... *B25F 5/02* (2013.01); *B24B 7/00* (2013.01); *B24B 23/00* (2013.01); *C22C 26/00* (2013.01)

(58) Field of Classification Search
CPC ... B25F 5/02; B24B 7/00; B24B 23/00; C22C 26/00
USPC ..... 451/5
See application file for complete search history.

(56) References Cited

U.S. PATENT DOCUMENTS 1,212,628 A * 1/1917 Gowlland ..... B24D 13/16 15/230.16
2,458,217 A * 1/1949 Staggs ..... B24D 9/02 451/507
5,096,465 A 3/1992 Chen et al.
5,185,970 A * 2/1993 Fiocchi ..... B24D 9/02 451/490
5,453,106 A 9/1995 Roberts
5,672,096 A * 9/1997 Amarosa, Sr. ..... B24D 9/02 451/504
5,762,546 A * 6/1998 James ..... B24B 13/012 451/504
5,931,719 A * 8/1999 Nagahara ..... B24B 37/20 451/287
6,669,745 B2 12/2003 Prichard et al.
2003/0084894 A1 5/2003 Sung
2004/0229553 A1 11/2004 Bechtold et al.
(Continued)

OTHER PUBLICATIONS

Slawomir Gogler, Grzegorz Bieszczad, Michal Krupinski, Precision asphere polishing with MRF technology and Subaperture Stitching Interferometry, Photonics Letters of Poland, 2013, pp. 128-130, vol. 5 (4), Photonics Society of Poland.

*Primary Examiner* — George B Nguyen
(74) *Attorney, Agent, or Firm* — James J. McGroary

(57) ABSTRACT

A surface grinding tool includes a support housing adapted to be coupled to a source of pressurized gas. The housing includes a conduit for directing the pressurized gas to an open end of the housing. A flexible sealing membrane is coupled to the housing such that the sealing membrane spans the housing's open end to prevent the pressurized gas from passing through and around the sealing membrane. A plate having through holes is coupled to the housing. The plate has a first face disposed adjacent to the sealing membrane and a second face opposing the first face. Each of a plurality of grinding elements is coupled to the sealing membrane and to the first face of the plate. Each grinding element has a portion thereof passing loosely through one of the through holes and extending away from the second face of the plate.

23 Claims, 3 Drawing Sheets

(56) References Cited

U.S. PATENT DOCUMENTS

| | | | |
|---|---|---|---|
| 2007/0049175 | A1 | 3/2007 | Kim et al. |
| 2008/0026678 | A1 | 1/2008 | Kim et al. |
| 2008/0132150 | A1 | 6/2008 | Arserio et al. |
| 2009/0202781 | A1 | 8/2009 | Hall et al. |

* cited by examiner

SURFACE GRINDING TOOL

ORIGIN OF THE INVENTION

The invention described herein was made by AN employee of the United States Government and may be manufactured and used by or for the Government of the United States of America for governmental purposes without the payment of any royalties thereon or therefor.

BACKGROUND OF THE INVENTION

1. Field of the Invention

This invention relates to grinding tools. More specifically, the invention is a grinding tool that can be adapted to work on a variety of surface materials and shapes.

2. Description of the Related Art

Precision grinding and/or polishing operations are standard steps used in the manufacturing of optical surfaces, silicon wafers for semi-conductor production, medical devices such as artificial joints, and other precision manufacturing operations. For example, multi-axis "computer numerically controlled" (CNC) polishing machines and precision grinding/polishing machines are used worldwide to prepare lenses used in optical devices. However, neither CNC polishing machines nor precision grinding/polishing machines are effective at removing what are known as mid-spatial frequency errors that cause small-angle scatter and flare that distort the image produced by an optical device. As is known in the art, mid-spatial frequency errors are caused by periodic types of manufacturing-induced surface imperfections whose periods are in the range of 1 to 15 millimeters.

Silicon wafer manufacturing includes an operation known as back grinding in which wafer thickness is reduced to allow for the stacking and high density packaging of integrated circuits. Back grinding is completed after the wafer is built on one side. Briefly, in back grinding, one side of the wafer is protected while the opposing side is thinned down via fine grinding so that its final thickness is between 50 and 100 microns. The back grinding process can introduce scratches and chip the surface layer of the material thereby creating a stressed surface that can render the wafer unusable. Accordingly, a process known as ductile grinding is employed in which a shear removal of the material from the wafer produces a stress-free surface. However, current industry platforms for completing ductile grinding are time consuming and require expensive tooling. For example, ductile grinders use diamond platens that must be resurfaced with diamond material, lapped, and reinstalled onto a grinding machine, a process requiring extensive setup time and man hours.

Medical devices such as artificial joints present a variety of shapes in a single device. That is, a single artificial joint can simultaneously present flat, concave, convex, spherical, and aspherical surface regions. Since all joint surfaces will interface with some natural anatomical structure or feature, it is desirable for all such interfacing surfaces to be free of surface defects to minimize incompatibility and/or fit issues.

SUMMARY OF THE INVENTION

Accordingly, it is an object of the present invention to provide a surface grinding tool.

Another object of the present invention is to provide a surface grinding tool that can be used on a variety surface materials and shapes.

Other objects and advantages of the present invention will become more obvious hereinafter in the specification and drawings.

In accordance with the present invention, a surface grinding tool includes a support housing adapted to be coupled to a source of pressurized gas. The support housing includes a conduit for directing the pressurized gas to an open end of the support housing. A flexible sealing membrane is coupled to the support housing such that the sealing membrane spans the housing's open end and such that the pressurized gas is prevented from passing through and around the sealing membrane. A plate having a plurality of through holes is coupled to the support housing. The plate has a first face disposed adjacent to the sealing membrane and a second face opposing the first face. Each of a plurality of grinding elements is coupled to the sealing membrane and to the first face of the plate. Each grinding element has a portion thereof passing loosely through one of the through holes and extending away from the second face of the plate.

BRIEF DESCRIPTION OF THE DRAWING(S)

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
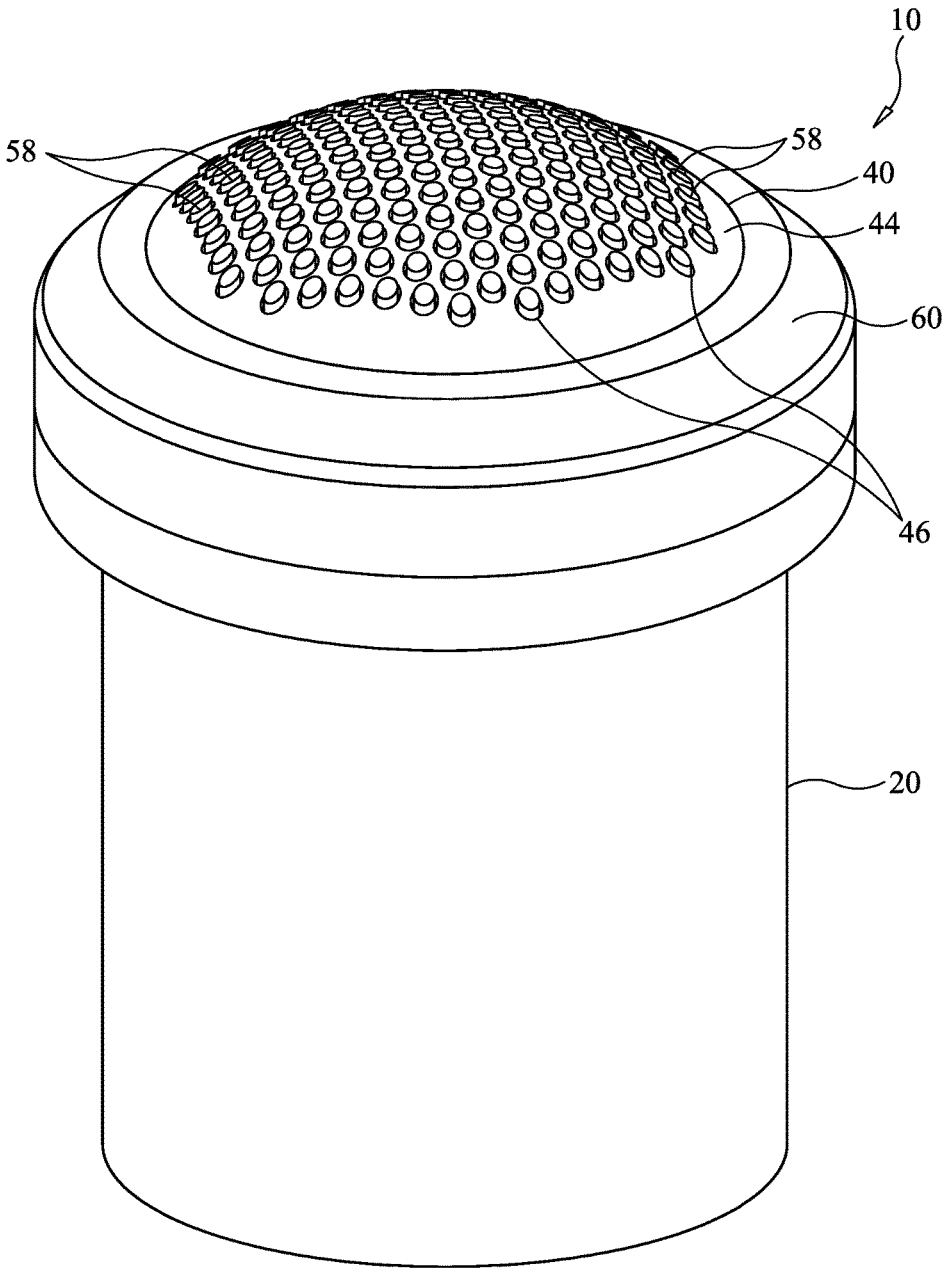
FIG. 1 is a perspective view of a surface grinding tool in accordance with an embodiment of the present invention.
Figure 2:
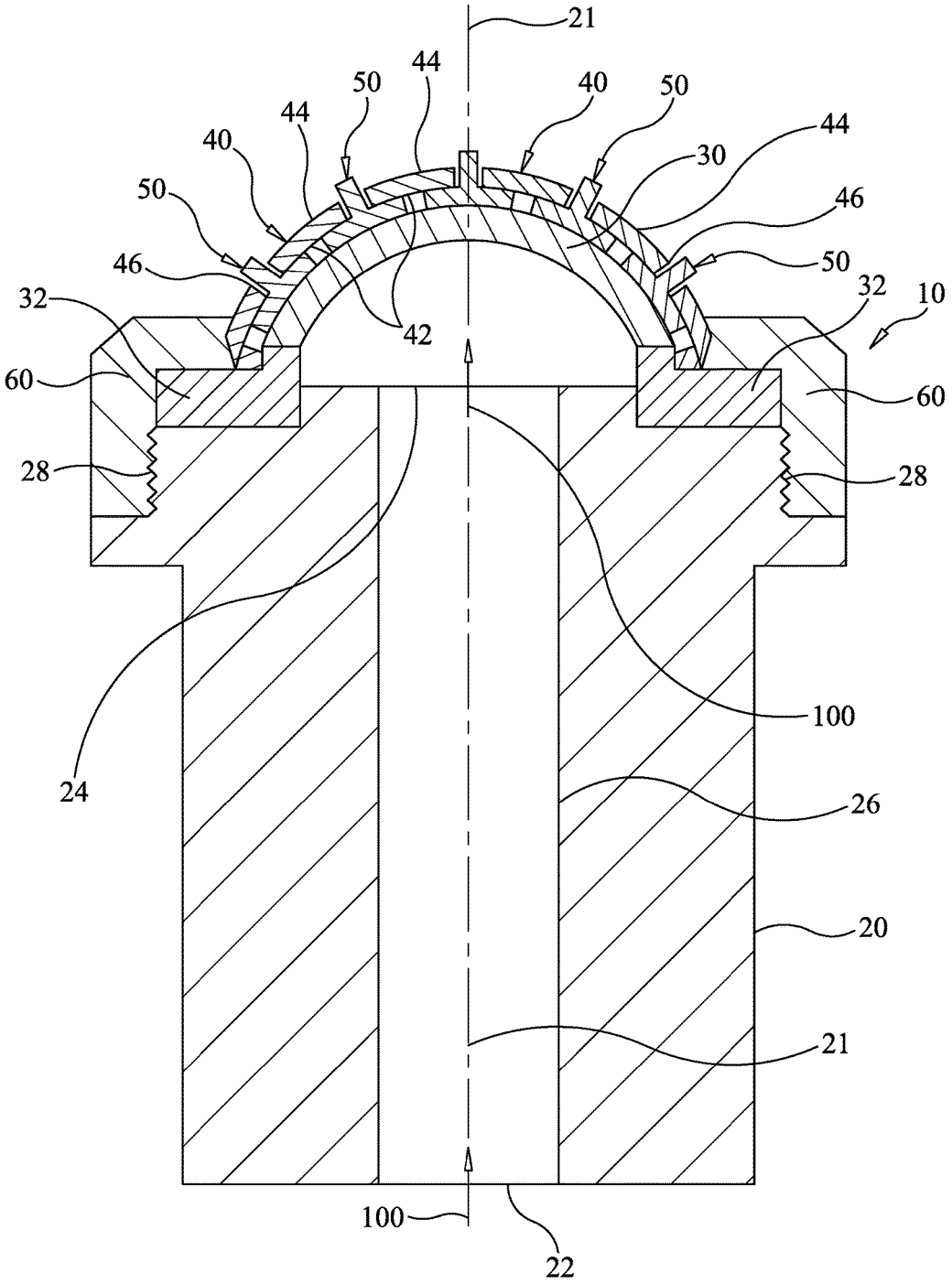
FIG. 2 is an axial cross-sectional view of the surface grinding tool illustrated in FIG. 1.

Referring now to the drawings, simultaneous reference will be made to FIGS. 1 and 2 where a surface grinding tool in accordance with an embodiment of the present invention is shown and is referenced generally by numeral 10. The grinding tool of the present invention can be configured to operate (e.g., grind and/or polish) on a variety of materials and/or surfaces to include, for example, optical materials and surfaces, semiconductor materials and surfaces, and medical appliance materials and surfaces. However, in each case/application, the basic features of surface grinding tool 10 will remain the same as will be described herein.

Figure 3:
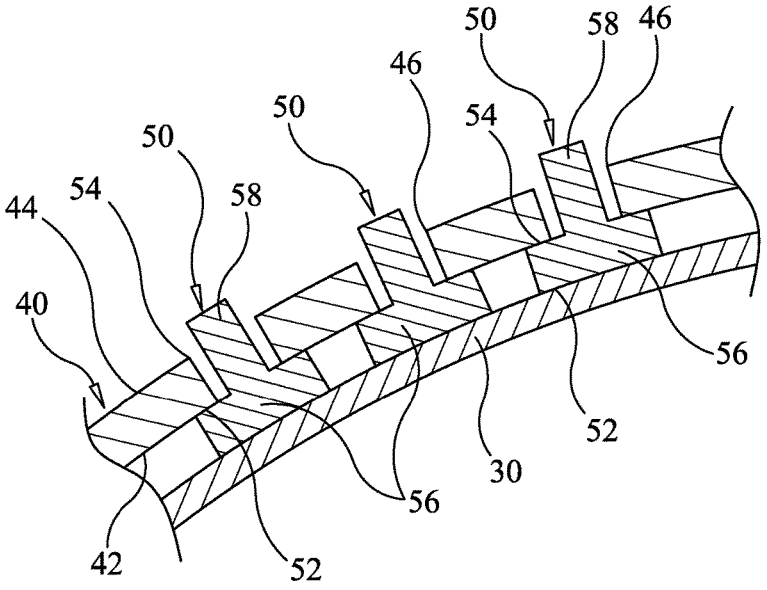
FIG. 3 is an enlarged cross-sectional view illustrating a portion of the surface grinding tool's flexible sealing membrane, grinding elements, and plate.
Figure 4:
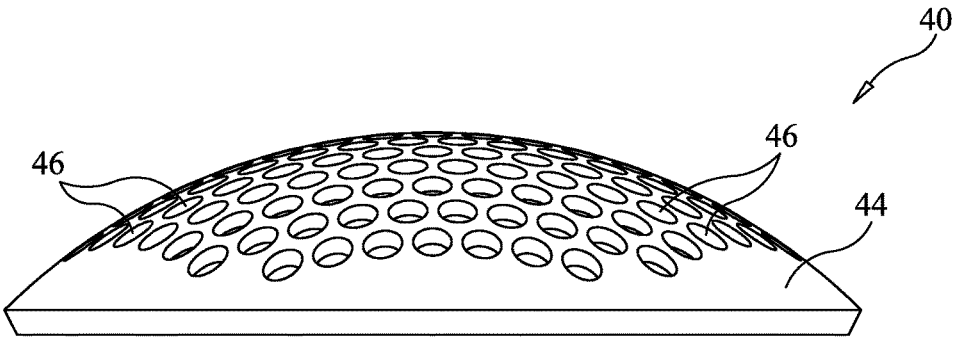
FIG. 4 is an isolated side view of the plate in accordance with an embodiment of the present invention.

Surface grinding tool 10 includes a main support housing 20, a flexible sealing membrane 30, a plate 40, and a plurality of grinding elements 50, each of which partially protrudes from plate 40. For clarity of illustration, the cross-sectional views in FIGS. 2 and 3 only show a few of grinding elements 50 as compared to the number shown in FIG. 1. Support housing 20 is generally made from a rigid material and is configured to be hand-held or fit into a machine (not shown) that can vibrate and/or rotate surface grinding tool 10. Accordingly, it is to be understood that the size, shape and material(s) used for support housing 20 can be changed without departing from the scope of the present invention. In the illustrated embodiment, support housing 20 is a generally tubular structure having open ends 22 and 24 fluidly coupled to one another by a conduit region 26 of support housing 20. As illustrated, conduit region 26 extends along the longitudinal axis 21 of support housing 20. For reasons that will be explained further below, a pressurized gas (indicated by arrow 100) is introduced into open end 22 and is directed along conduit region 26 to open end 24. Disposed on the outside of support housing 20 at open end 24 are threads 28 for threaded engagement with a retaining ring 60.

In general, flexible sealing membrane 30 is coupled to support housing 20 such that it seals open end 24 in a way that pressurized gas 100 cannot pass through or around sealing membrane 30. Sealing membrane 30 can be made from a variety of flexible and gas impervious elastic materials such as, but not limited to, rubber, silicone, or polyurethane. Coupling of sealing membrane 30 to support housing 20 can be accomplished in a variety of ways without departing from the scope of the present invention. By way of a non-limiting example, sealing membrane 30 can be attached to a mounting ring 32 captured against support housing 20 by retaining ring 60. As would be understood in the art, sealing elements such as O-rings (not shown) can be used to provide an airtight seal between support housing 20 and mounting ring 32, and between mounting ring 32 and retaining ring 60.

Plate 40 is also coupled to support housing 20 where such coupling can be accomplished in a variety of ways without departing from the scope of the present invention. By way of a non-limiting example, plate 40 is captured in position using retaining ring 60 that bears against the periphery of plate 40 when retaining ring 60 is in threaded engagement with threads 28 on support housing 20. With plate 40 so-coupled to support housing 20, one face 42 of plate 40 is adjacent to sealing membrane 30 and the opposing face 44 of plate 40 is exposed to the ambient environment.

In the illustrated embodiment, plate 40 is configured such that face 44 is a convex surface such as a portion of a sphere. Depending on the application, plate 40 can be made from a rigid material (e.g., metal, composite) or flexible material (e.g., plastic). Regardless of its shape, rigidity, or flexibility, plate 40 has a plurality of through holes 46 passing all the way through plate 40. Each of holes 46 can be the same size or different without departing from the scope of the present invention. Holes 46 can be circular as shown, but can comprise other geometries without departing from the scope of the present invention. Each hole 46 is sized to loosely receive a portion of one of grinding elements 50 there through as will be explained further below. That is, the diameter of each hole 46 must be larger than the outer diameter of the portion of a corresponding grinding element 50 passing there through.

Grinding elements 50 are the portion of surface grinding tool 10 that will interface with a workpiece (not shown) during a grinding or polishing operation. Additional reference is made to FIG. 3 where each grinding element 50 is coupled to face 42 of plate 40 (as indicated by reference numeral 52) and sealing membrane 30 (as indicated by reference numeral 54). Such coupling can be made using a variety of adhesives as would be understood in the art. In the illustrated embodiment, each grinding element 50 includes a mounting flange 56 that is adhered to each of face 42 and sealing membrane 30, and a cylindrical portion 58 extending from flange 56 to pass through one of holes 46 and extend beyond face 44. Each grinding element 50 can be made from polycrystalline diamond, although other grinding/polishing materials can be used without departing from the scope of the present invention.

In use, pressurized gas 100 is supplied to surface grinding tool 10 to thereby apply pressure to sealing membrane 30 that, in turn, presses against grinding elements 50. The amount of gas pressure controls how much each cylindrical portion 58 can move within its corresponding and larger-diameter hole 46. At lower gas pressures, cylindrical portion 58 can readily experience side-to-side movement within its corresponding hole. However, the amount of possible side-to-side movement of cylindrical portions 58 decreases with increasing gas pressure thereby allowing a user to easily modify the tool's capabilities.

The advantages of the present invention are numerous. The surface grinding tool can be adjusted on-the-fly using gas pressure to accommodate different surfaces/materials or changing grinding/polishing needs as an operation progresses. The tool's head assembly to include its sealing membrane, plate, and grinding elements can be made to specifications for a particular material, surface, and/or application. The surface grinding tool is readily adapted for hand-held use or inclusion in a grinding/polishing machine.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A surface grinding tool, comprising:

a support housing adapted to be coupled to a source of pressurized gas, said support housing including a conduit for directing the pressurized gas to an open end of said support housing;

a flexible sealing membrane coupled to said support housing and spanning said open end thereof, wherein the pressurized gas is prevented from passing through and around said sealing membrane;

a plate having a plurality of through holes, said plate coupled to said support housing, said plate having a first face disposed adjacent to said sealing membrane and having a second face opposing said first face; and a plurality of grinding elements, each of said grinding elements coupled to said sealing membrane and to said first face of said plate, each of said grinding elements having a portion thereof passing loosely through one of said through holes and extending away from said second face of said plate.

2. A surface grinding tool as in claim 1, wherein said conduit in said support housing extends along a longitudinal axis of said support housing.

3. A surface grinding tool as in claim 1, wherein said sealing membrane comprises an elastic material.

4. A surface grinding tool as in claim 1, wherein said plate comprises a rigid material.

5. A surface grinding tool as in claim 1, wherein said plate comprises a flexible material.

6. A surface grinding tool as in claim 1, wherein said second face of said plate comprises a convex surface.

7. A surface grinding tool as in claim 1, wherein each of said through holes is identically sized.

8. A surface grinding tool as in claim 1, wherein said portion of each of said grinding elements is cylindrical.

9. A surface grinding tool as in claim 1, wherein said portion of each of said grinding elements comprises polycrystalline diamond.

10. A surface grinding tool, comprising:

a tubular housing having a first open end and a second open end, said first open end adapted to be coupled to a source of pressurized gas, wherein the pressurized gas is directed to said second open end;

a flexible sealing membrane coupled to said tubular housing and spanning said second open end thereof, wherein the pressurized gas is prevented from passing through and around said sealing membrane;

a plate having a plurality of through holes, said plate coupled to said tubular housing wherein said sealing membrane is disposed between said second open end and said plate, said plate having a first face disposed adjacent to said sealing membrane and having a second face opposing said first face; and a plurality of grinding elements, each of said grinding elements coupled to said sealing membrane and to said first face of said plate, each of said grinding elements having a portion thereof passing loosely through one of said through holes and extending away from said second face of said plate.

11. A surface grinding tool as in claim 10, wherein said sealing membrane comprises an elastic material.

12. A surface grinding tool as in claim 10, wherein said plate comprises a rigid material.

13. A surface grinding tool as in claim 10, wherein said plate comprises a flexible material.

14. A surface grinding tool as in claim 10, wherein said second face of said plate comprises a convex surface.

15. A surface grinding tool as in claim 10, wherein each of said through holes is identically sized.

16. A surface grinding tool as in claim 10, wherein said portion of each of said grinding elements is cylindrical.

17. A surface grinding tool as in claim 10, wherein said portion of each of said grinding elements comprises polycrystalline diamond.

18. A surface grinding tool, comprising:

a support housing adapted to be coupled to a source of pressurized gas, said support housing including a conduit for directing the pressurized gas to an open end of said support housing;

a flexible sealing membrane coupled to said support housing and spanning said open end thereof, wherein the pressurized gas is prevented from passing through and around said sealing membrane;

a plate having a plurality of through holes, said plate coupled to said support housing, said plate having a first face disposed adjacent to said sealing membrane and having a second face opposing said first face, said second face presenting a convex surface; and a plurality of grinding elements, each of said grinding elements coupled to said sealing membrane and to said first face of said plate, each of said grinding elements having a cylindrical portion thereof passing loosely through one of said through holes and extending away from said second face of said plate.

19. A surface grinding tool as in claim 18, wherein said sealing membrane comprises an elastic material.

20. A surface grinding tool as in claim 18, wherein said plate comprises a rigid material.

21. A surface grinding tool as in claim 18, wherein said plate comprises a flexible material.

22. A surface grinding tool as in claim 18, wherein each of said through holes is identically sized.

23. A surface grinding tool as in claim 1, wherein said cylindrical portion of each of said grinding elements comprises polycrystalline diamond.

* * * * *